US007202833B2

(12) United States Patent
Ho et al.

(10) Patent No.: US 7,202,833 B2
(45) Date of Patent: Apr. 10, 2007

(54) TRI-HEAD KAKUKA FEED FOR SINGLE-OFFSET DISH ANTENNA

(75) Inventors: Kesse Ho, Westminster, CA (US); John Norin, Hawthorne, CA (US); Ernest C. Chen, San Pedro, CA (US); Joseph Santoru, Agoura Hills, CA (US)

(73) Assignee: The DirecTV Group, Inc., El Segundo, CA (US)

( * ) Notice: Subject to any disclaimer, the term of this patent is extended or adjusted under 35 U.S.C. 154(b) by 182 days.

(21) Appl. No.: 11/015,705

(22) Filed: Dec. 17, 2004

(65) Prior Publication Data

US 2005/0162330 A1 Jul. 28, 2005

Related U.S. Application Data

(60) Provisional application No. 60/530,435, filed on Dec. 17, 2003.

(51) Int. Cl.
*H01Q 13/00* (2006.01)

(52) U.S. Cl. ..... 343/786; 343/779

(58) Field of Classification Search ..... 343/772, 343/776, 779, 786
See application file for complete search history.

(56) References Cited

U.S. PATENT DOCUMENTS 5,812,096 A * 9/1998 Tilford ..... 343/781 R
6,600,730 B1 * 7/2003 Davis et al. ..... 370/343
7,068,616 B2 * 6/2006 Chang et al. ..... 370/316

* cited by examiner

*Primary Examiner*—Shih-Chao Chen
(74) *Attorney, Agent, or Firm*—Georgann S. Grunebach

(57) ABSTRACT

A method and apparatus for receiving signals transmitted from a plurality of communications satellites. An apparatus in accordance with the present invention comprises a reflecting surface having a focal point, and a plurality of low noise block down converters with feedhorns (LNBFs), each LNBF having a boresight, wherein at least a first LNBF receives signals in a first frequency band transmitted from a first communication satellite location that are focused at a first focal point and at least a second LNBF receives signals in a second frequency band transmitted from a second satellite location that are focused at a second focal point, wherein the boresight of the first LNBF is closer to the first focal point than the boresight of the second LNBF is to the second focal point.

16 Claims, 8 Drawing Sheets

TRI-HEAD KAKUKA FEED FOR SINGLE-OFFSET DISH ANTENNA

CROSS-REFERENCE TO RELATED APPLICATIONS

This application claims priority under 35 U.S.C. § 119(e) of patent application Ser. No. 60/530,435, filed Dec. 17, 2003 by Kesse Ho et al., entitled, "TRI-HEAD KaKuKa FEED FOR SINGLE-OFFSET DISH ANTENNA," the contents of which are incorporated by reference herein.

BACKGROUND OF THE INVENTION

1. Field of the Invention

The present invention relates generally to direct broadcast satellite systems, and in particular, to a tri-head KaKuKa feed for a single-offset dish antenna.

2. Description of the Related Art

Satellite broadcasting of communications signals has become commonplace. Satellite distribution of commercial signals for use in television programming currently utilizes multiple feedhorns on a single Outdoor Unit (ODU) which supply signals to up to four Integrated Receiver-Decoders (IRDs) on separate cables from an integrated multiswitch. Additional IRDs can be serviced with external cascaded multiswitches.

DIRECTV® currently broadcasts video programming signals from transponders on three satellites in three different orbital slots located at 101 West Longitude (WL), 119 WL, and 110 WL, also known as Sat A, Sat B, and Sat C, respectively. The FCC (Federal Communications Commission) has allocated to DIRECTV® transponders 1–32 on 101 WL, transponders 22–32 on 119 WL, and transponders 28, 30, 32 on 110 WL.

These satellites broadcast in the Ku-band of frequencies, typically between 12.2 GHz and 12.7 GHz. Additional satellites are currently being contemplated for use with the DIRECTV® system, which will broadcast in the Ka-band of frequencies, typically between 18 and 20 GHz. The additional satellites can be placed on-orbit at any location, but currently, the locations are expected to be at 99 WL and 103 WL. Additional satellites may be placed at other locations, such as 101 WL.

Although additional ODUs can be installed to receive the Ka-band frequencies, installation of an additional ODU at a given location may be difficult, as well as costly. Further, multiple ODU installations will be difficult to connect to existing systems, because of potential additional cable runs as well as possible interference with existing equipment.

It can be seen that there is a need in the art for an ODU that can receive both Ka-band and Ku-band signals. There is also a need for a method that takes into account the position of the satellites that are transmitting these frequencies, as well as designing the ODU to maximize the signal strength from the Ka-band.

SUMMARY OF THE INVENTION

The present invention describes an antenna system, or Outdoor Unit (ODU), that provides the capability to receive signals transmitted from a plurality of communications satellites. An apparatus in accordance with the present invention comprises a reflecting surface having a focal point, and a plurality of low noise block down converters with feedhorns (LNBFs), each LNBF having a boresight, wherein at least a first LNBF receives signals in a first frequency band transmitted from a first communication satellite location that are focused at a first focal point and at least a second LNBF receives signals in a second frequency band transmitted from a second satellite location that are focused at a second focal point, wherein the boresight of the first LNBF is closer to the first focal point than the boresight of the second LNBF is to the second focal point.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which show, by way of illustration, several embodiments of the present invention. It is understood that other embodiments may be utilized and structural changes may be made without departing from the scope of the present invention.

Figure 1:
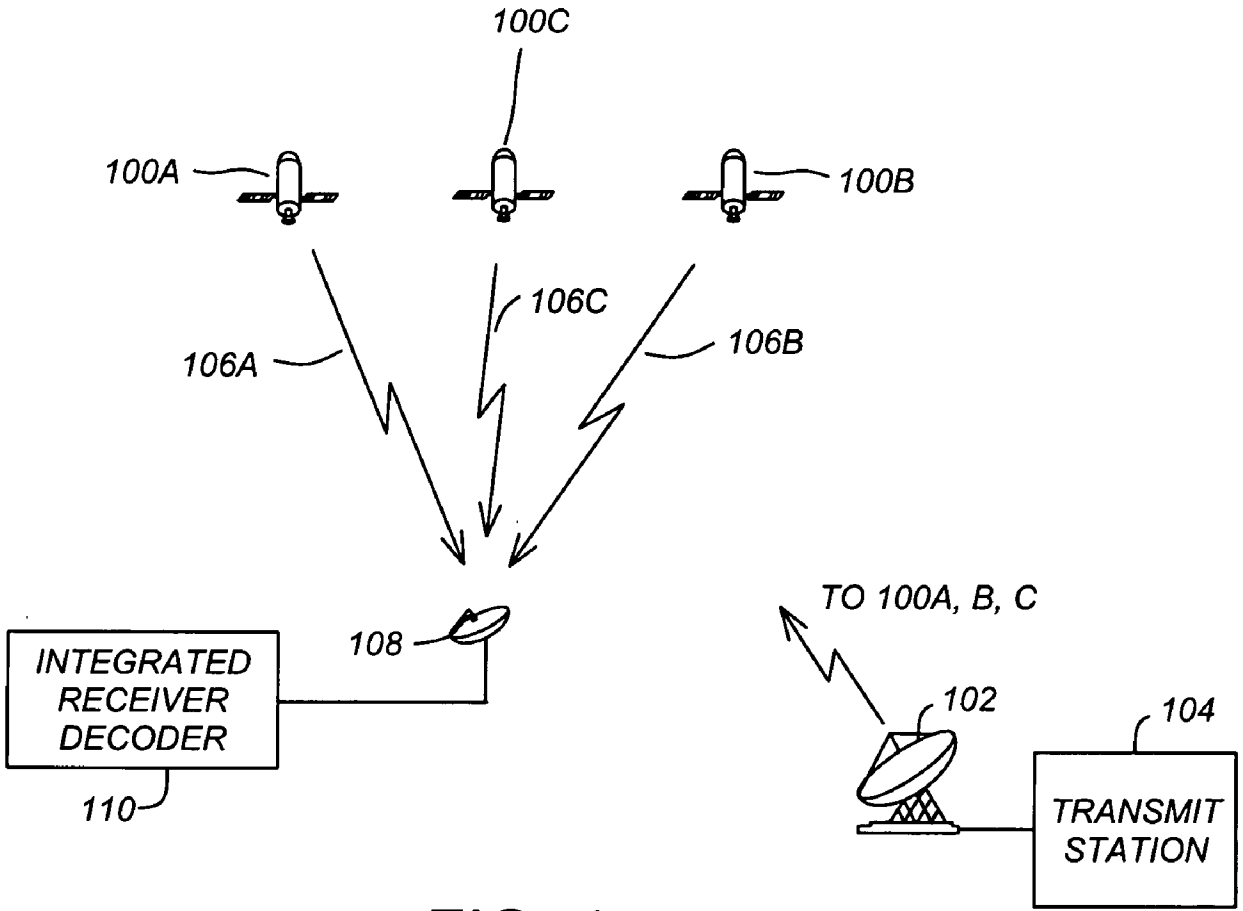
FIG. 1 (Prior Art)
FIG. 1 is a diagram illustrating an overview of a prior art multiple satellite video distribution system according to the preferred embodiment of the present invention.

FIG. 1 is a diagram illustrating an overview of a multiple satellite video distribution system according to the preferred embodiment of the present invention. The system includes multiple satellites 100A–C, uplink antenna 102, and transmit station 104. In the preferred embodiment, the three satellites 100A–C are in three different orbital slots located at 101 West Longitude (WL) 100A, 119 WL 100B, and 110 WL 100C, wherein the video programming signals 106A–C are transmitted from transponders 1–32 on 101 WL 100A, transponders 22–32 on 119 WL 100B, and transponders 28, 30, and 32 on 110 WL 100C. Additional satellites 100A–C can be located at additional orbital slots, or additional satellites can be present at the listed orbital slots, without departing from the scope of the present invention.

The radio frequency (RF) signals 106A–C are received at one or more downlink antennae 108, which in the preferred embodiment comprise subscriber receiving station antennae 108, also known as outdoor units (ODUs). Each downlink antennae 108 is coupled to one or more integrated receiver-decoders (IRDs) 110 for the reception and decoding of video programming signals 106A–C.

Figure 2:
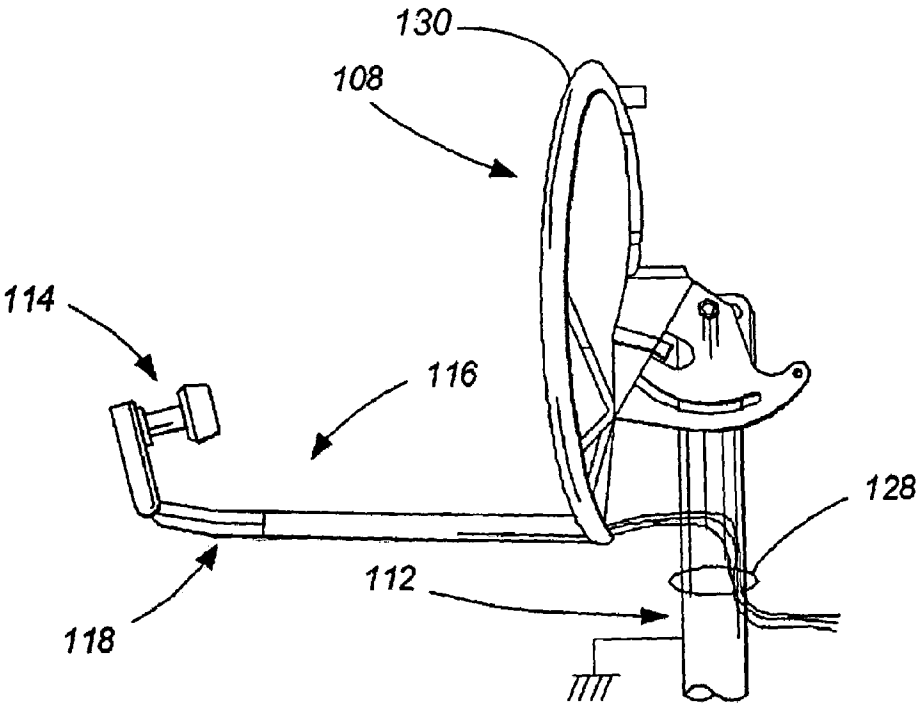
FIG. 2 (Prior Art)
FIGS. 2 & 2A illustrate an antenna configured according to the preferred embodiment of the present invention.
Figure 2A:
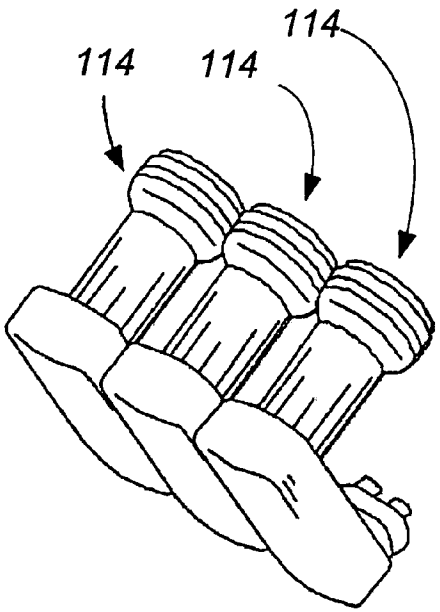
FIG. 2A (Prior Art)

FIG. 2 illustrates the subscriber antenna 108 as configured according to the related art. In the side view of FIG. 2, the antenna 108 has an 18"×24" oval-shaped Ku-band reflecting surface that is supported by a mast 112, wherein a minor axis (top to bottom) of the reflecting surface is narrower than its major axis (left to right). The antenna 108 curvature is due to the offset of one or more low noise block down converters with feed (LNBFs) 114, which are used to receive signals reflected from the antenna 108. FIG. 2A illustrates a perspective view of the LNBFs 114 of FIG. 2, located at the end of support bracket 116. Although three LNBFs 114 are shown in FIG. 2A, a greater or lesser number of LNBFs 114 can be utilized for a given antenna 108 without departing from the scope of the present invention. The number of LNBFs 114 shown is merely for illustrative purposes and in no way limits the scope of the present invention.

In the preferred embodiment, a support bracket 116 positions an LNBF/Multi-SW Adapter 118 and multiple LNBFs 114 below the front and center of the antenna 108, so that the LNBFs 114 do not block the incoming signals 106A–C. Moreover, the support bracket 116 sets the focal distance between the antenna 108 and the LNBFs 114.

The LNBFs 114 comprise a first stage of electronic amplification for the subscriber receiving station. Each LNBF 114 down converts the signals 106A–C received from the satellites to a lower frequency that is recognized and used by a tuner/demodulator of the IRD 110. Typically, the signals 106A–C are in the 12.2–12.7 GHz range, and are downconverted to 950–1450 MHz signals used by the tuner/demodulator of the IRD 110. The shape and curvature of the antenna 108 allows the antenna 108 to simultaneously direct energy into two or three proximately disposed LNBFs 114. Each LNBF 114 is typically optimized at a focal point based on the satellite location a given LNBF 114 is designed to be responsive to.

However, once additional satellites of a different frequency range, typically in the Ka-band frequency range, are transmitting signals, the antenna 108 dish 130 must change in size and/or shape to reflect enough incident radiated power to the LNBF 114 such that the signals in the different frequency range can be detected and processed by the LNBF 114 and IRD 110.

Typically, the orbital locations of the satellites 100A–C are chosen so that the signals 106A–C received from each satellite 100A–C can be distinguished by the antenna 108, but close enough so that signals 106A–C can be received without physically slewing or otherwise altering the axis of the antenna 108 by moving antenna 108 to receive signals from the various satellites 100A–C. When the user selects program material broadcast by the satellites 100A–C, the IRD 110 electrically switches LNBFs 114 to receive the broadcast signals 106A–C from the satellites 100A–C. This electrical switching occurs using a combiner and multiswitch within the LNBF/Multi-SW Adapter 118.

The Ka-band satellites currently being contemplated are typically located at a two degree (2°) spacing from the Ka-band satellites, e.g., when a Ku-band satellite is nominally located at 101 WL, the Ka-band satellites are nominally located at 99 WL and 103 WL. However, other satellites that transmit in different frequency bands, or in the same frequency band, can be located at other orbital slots without departing from the scope of the present invention.

The 2° spacing of the satellites allows a single antenna reflector dish of proper size and design, to intercept enough incident radiated power from the satellites to provide the LNBFs with enough signal strength for amplification without degradation of signal content. The present invention utilizes an increased size of the antenna reflector dish 130, which is desirable for other frequency band satellite 100A–C transmissions, especially within the Ka-band of frequencies. This increased size of the antenna reflector dish 130 allows for additional incident radiated power from the Ku-band satellites to be intercepted, and, as such, an increased gain of the antenna 108 for the Ku-band LNBFs 114.

An increase in power for the Ku-band LNBFs 114 can create problems for any multiswitch that is coupled to the Ku-band and Ka-band LNBFs, since the difference in signal power levels will strain the dynamic range of the multiswitch. Further, placement of any Ka-band LNBF 114, whether there are one or more of the Ka-band LNBFs 114, is critical since the Ka-band transmissions are more weather dependent and have more difficulty in the amplification stages of a Ka-band LNBF 114. As such, placement of the Ka-band LNBF 114 closer to the focal point of the antenna 108 is desirable, and placement of the Ku-band LNBF 114 away from the focal point of the antenna 108 is also desirable. The present invention uses these design criteria to offset the Ku-band LNBF 114 from the focal point, as well as maintaining proximity of the Ka-band LNBF 114 to the focal point.

Figure 3:
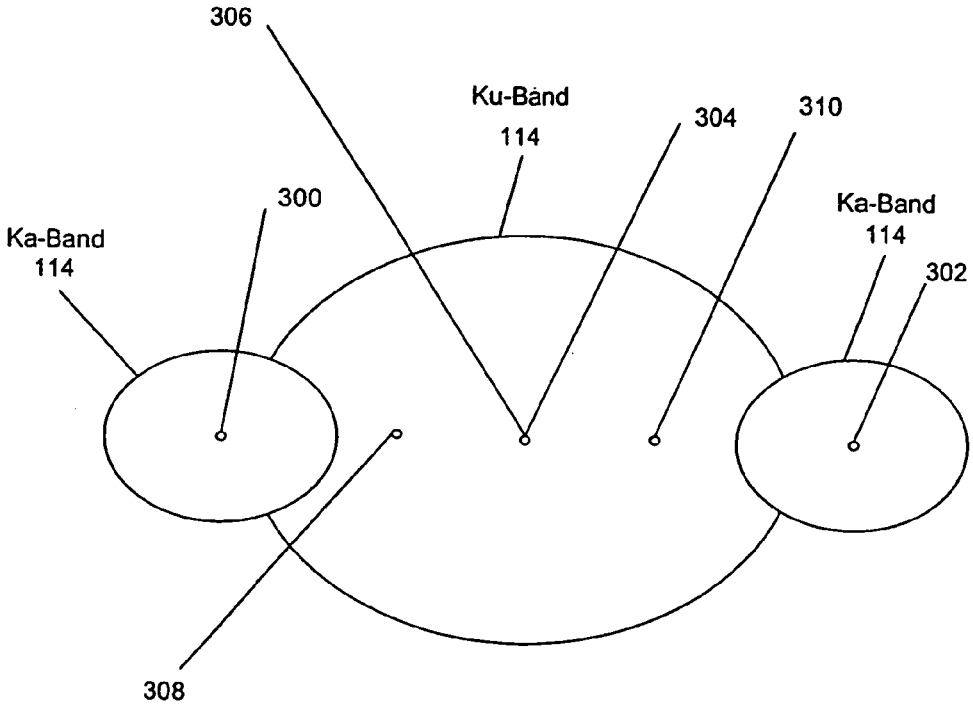
FIG. 3 (Prior Art)
FIG. 3 illustrates a head-on view of the feedhorn locations as viewed from the perspective of the dish reflector without offsetting of the Ku-band feedhorn.

FIG. 3 illustrates a head-on view of the feedhorn locations as viewed from the perspective of the dish reflector without offsetting of the Ku-band feedhorn. For a typical f/D antenna as currently used in the related art, the addition of two Ka-band LNBF 114 to the ODU 108 would result in a central Ku-band LNBF 114 and two lateral Ka-band LNBF 114. The location of the boresight (center of the feedhorn) for each of the feedhorns and/or waveguides associated with the Ka-band LNBF 114 would be at locations 300 and 302, and the waveguide(s) associated with the Ku-band LNBF would be at location 304. Each LNBF 114 is responsive to one or more satellites located at various orbital slots, and each orbital slot and/or satellite has an associated focal point 306 for a given reflector dish. So, as shown in FIG. 3, focal point 306 is associated with the orbital slot or satellite location that is sending signals designed to be received by Ku-band LNBF 114, and, thus, location 304 and focal point 306 are substantially co-located.

However, the focal point 308 that is associated with the orbital slot and/or satellite location delivering signals which are designed to be received by Ka-band LNBF 114 is not substantially co-located with the boresight 300 of Ka-band LNBF 114, and the focal point 310 that is associated with the orbital slot and/or satellite location delivering signals which are designed to be received by the other Ka-band LNBF 114 is not substantially co-located with boresight 302. Further, focal points 308 and 310 may, as shown in FIG. 3, lie within the feedhorn of one of the other LNBFs 114 that are present in a given ODU 108. The physical structure of Ku-band LNBF 114 and Ka-band LNBFs 114 would have to overlap or intersect to be able to place the Ka-band LNBFs 114 and the Ku-band LNBFs 114 at the proper focal points 306, 308, and 310, respectively. Although the physical structure of the LNBFs 114 may allow intersection of the LNBF 114 feedhorns, such a structure could be more costly to build, or have other undesired associated tradeoffs that could affect system performance.

Further, the design considerations for the Ka-band LNBF 114 are much different than that of the Ku-band LNBF 114, mostly because the Ka-band LNBF 114 is affected by meteorological effects, misalignment, and other frequency-related issues to a greater degree than the Ku-band LNBF 114.

Figure 4:
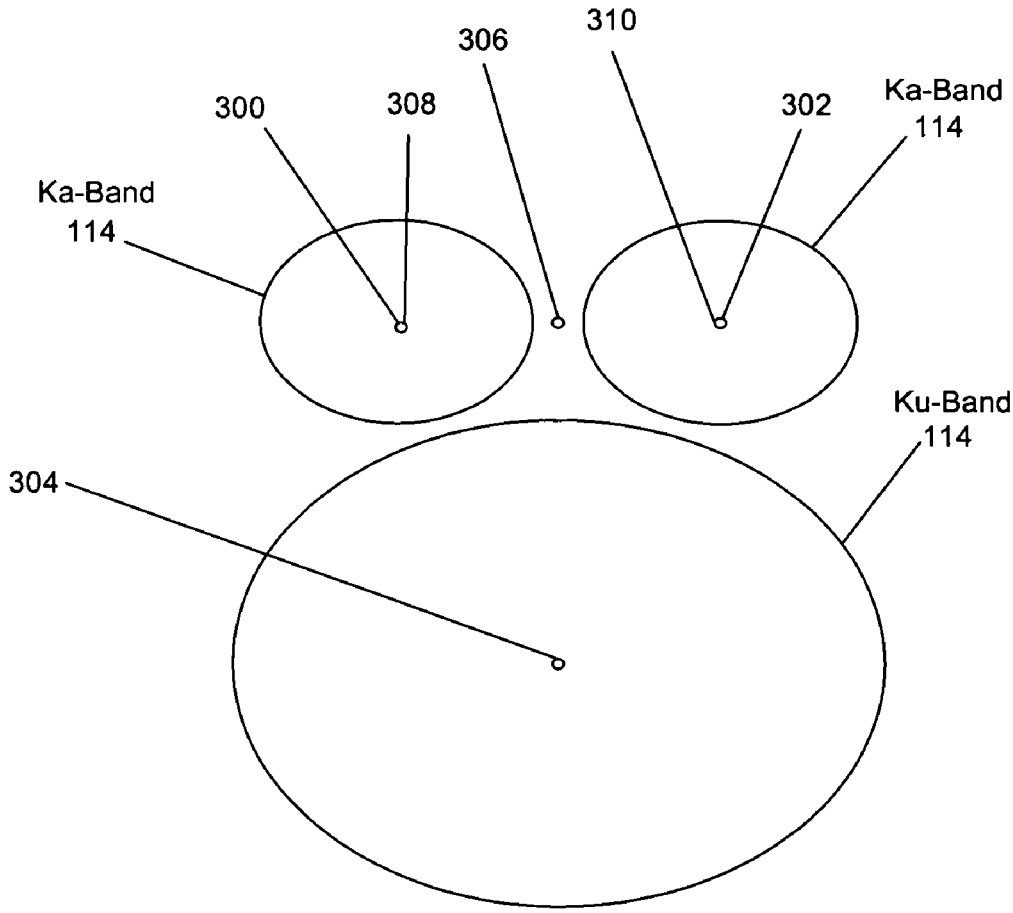
FIG. 4 illustrates a head-on view of the feedhorn locations as viewed from the perspective of the reflector dish in accordance with the present invention.

FIG. 4 illustrates a head-on view of the feedhorn locations as viewed from the perspective of the reflector dish in accordance with the present invention.

As shown in FIG. 4, the boresight locations 300 and 302 are placed closer to their respective focal points 308 and 310, and the boresight location 304 is moved away from its' respective focal point 306, to ensure that the Ka-band LNBF 114 receive the maximum available signal strength for a given antenna reflector dish. The Ku-band LNBF 114 boresight location 304 is moved away from the focal point 306, with a corresponding performance impact on the signal strength of Ku-band signals received at Ku-band LNBF 114. However, although there will be some sort of loss of signal strength, the movement of the Ku-band LNBF 114 boresight 304 away from the focal point 306 is possible because the antenna dish reflector is of a larger size than that required for an all Ku-band LNBF 114 ODU 108. Since the reflector is now intercepting more of the Ku-band signal, it will be providing a larger gain at the focal point 306, more gain than the Ku-band LNBF 114 requires. Rather than discard the additional power later in the system, the present invention takes this power surplus to choose the boresight location 304 of the Ku-band LNBF 114. If the reflector dish is large enough, the boresight location 304 can be placed very far away from the focal point, but such a reflector dish would be difficult to install.

As such, the physical structures and constraints of the LNBF 114 no longer present a problem to physical construction of a system that uses the multiple LNBF 114. However, there is a performance impact on those LNBF 114 that are moved away from their optimized location (e.g., where the boresight of the LNBF 114 is moved away from the focal point associated with the signals that are designed to be received by that LNBF 114) which is typically, at least in part, rectified by an increased reflector dish size. The amount of correction that increased sized reflectors can provide depends on the distance that the LNBF 114 is moved from the focal point, the size and shape of the overall reflector, and the pointing error associated with a given reflector installation.

It is also possible to transmit multiple bands from a given orbital location or a given satellite. In such situations, it may be desirable to place the boresight of one LNBF 114 directly on the focal point associated with that orbital location, while the boresight of another LNBF, responsive to that same orbital location but in a different transmission band, away from the focal point associated with that orbital location or satellite.

Further, if there is only one Ka-band LNBF 114, the boresight location 300 can be co-located with the focal point 306, and the boresight location 304 can be selected to be as close to focal point 306 as possible. Although shown as being below focal point 306 in FIG. 4, the present invention contemplates placing the boresight location 304 of the Ku-band LNBF 114 at other locations without departing from the scope of the present invention.

Figure 5:
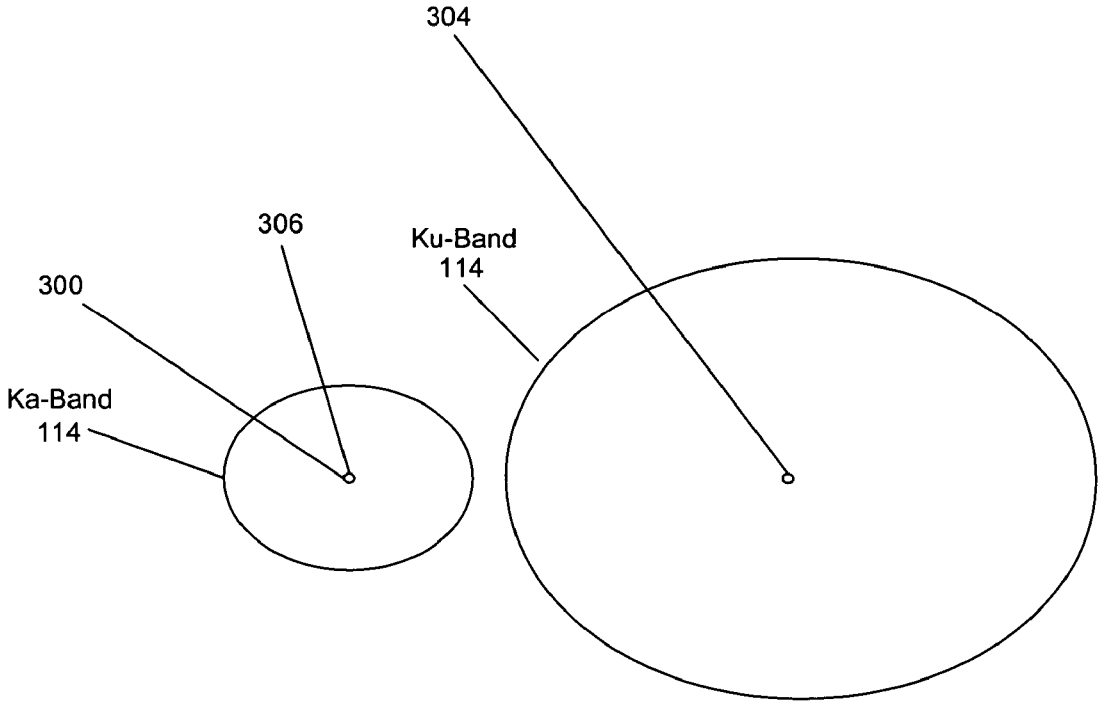
FIG. 5 illustrates a head-on view of an alternative arrangement of feedhorn locations as viewed from the perspective of the reflector dish in accordance with the present invention.

FIG. 5 illustrates a head-on view of an alternative arrangement of feedhorn locations as viewed from the perspective of the reflector dish in accordance with the present invention.

When a given orbital slot or satellite transmits in multiple frequency bands, the focal point for both frequency bands will be the same at a given ODU 108. As such, the optimal placement of the LNBFs 114 will be at the same point, which, as discussed with respect to FIG. 3, may not be desirable because of construction techniques, cost, or other factors. Since the Ka-band signals are affected to a greater degree than the Ku-band signals, the boresight location 300 and focal point 306 are co-located for Ka-band LNBF 114, and boresight location 304 for Ku-band LNBF 114 is co-linear with the boresight location 300 and focal point 306. Many other combinations of co-linearity, co-location, and boresight location 300–304 are possible given the teachings of the present invention. As can be seen, the location of the boresight of any Ka-band LNBFs 114 is primary, and the location of the boresight Ku-band LNBF 114 is subordinate to the location of the boresight of at least one of the Ka-band LNBFs 114.

Figure 6:
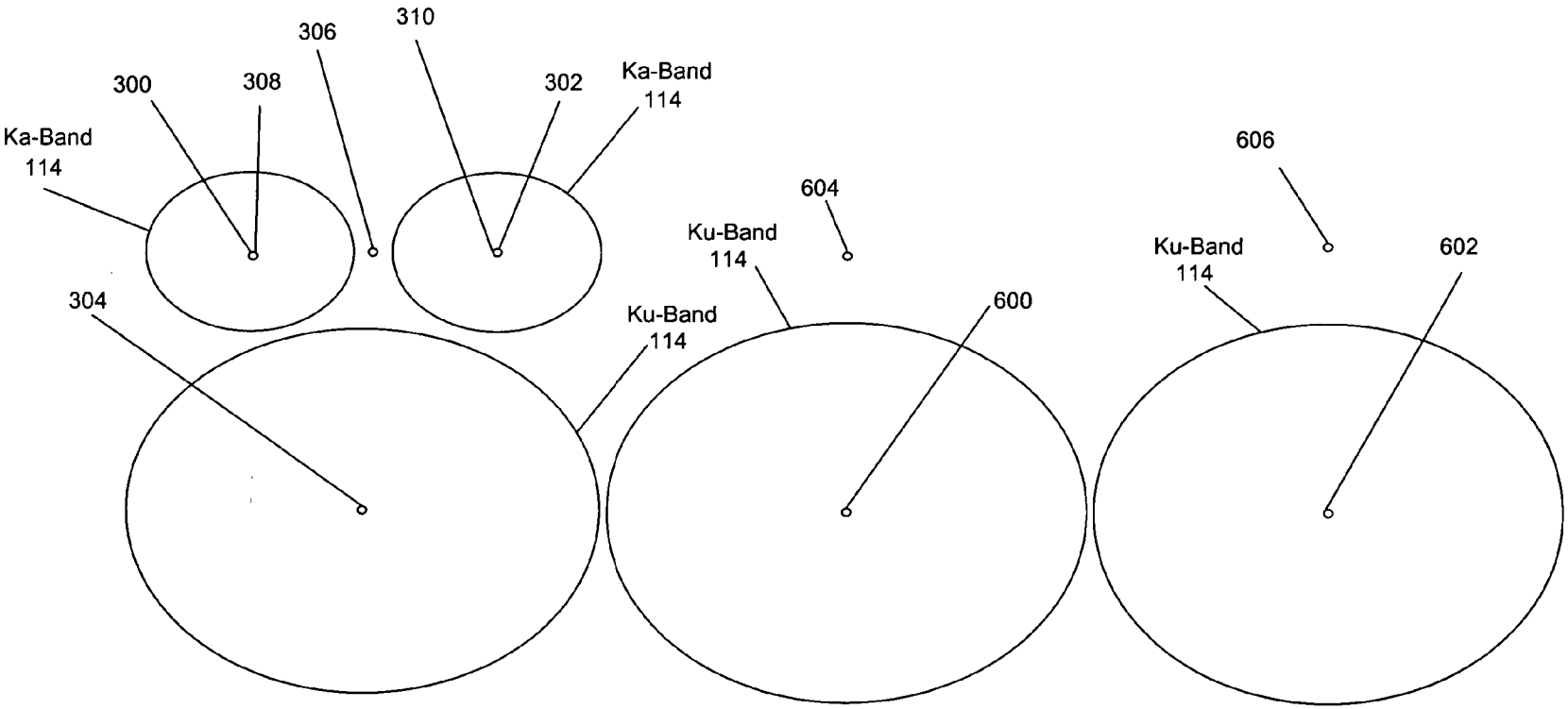
FIG. 6 illustrates a head-on view of an alternative arrangement of feedhorn locations as viewed from the perspective of the reflector dish in accordance with the present invention.

FIG. 6 illustrates a head-on view of an alternative arrangement of feedhorn locations as viewed from the perspective of the reflector dish in accordance with the present invention.

Currently, there are three Ku-band LNBF 114, each placed at a focal point associated with various orbital slots, which are currently located at 101 degrees, 110 degrees, and 119 degrees West Longitude, respectively. As shown in FIG. 6, three Ku-band LNBF 114 are placed away from their corresponding focal points, while Ka-band LNBFs 114 are placed at their corresponding focal points.

As such, additional Ku-band LNBF 114 with boresight 600 and Ku-band LNBF 114 with boresight 602 are shown. Although Ku-band LNBF 114 with boresight 600 is designed to receive signals from a satellite location that will be focused at focal point 604, and Ku-band LNBF 114 with boresight 602 is designed to receive signals from a satellite location that will be focused at focal point 606, because of the physical interference of Ka-band LNBFs 114, boresights 600 and 602 must be moved off-focus. The distance between focal point 604 and boresight 600 and focal point 606 and boresight 602 will be minimized as much as possible given the physical constraints of the LNBFs 114 utilized in a given configuration. It may be possible to place one or more of the boresights 304, 600, and 602 closer to the respective focal point 306, 604, and 606 than the other boresights. So for example, and not by way of limitation, the distance between boresight 600 and focal point 604 may be smaller than the distance between boresight 602 and focal point 606, depending on the configuration of the LNBFs 114 present in a given system. If, for example, Ka-band LNBF 114 with boresight 302 is not present in a given system, then it may be possible to place Ku-band LNBF 114 with boresight 600 directly at the focal point 604, and Ku-band LNBF with boresight 602 directly at focal point 606. Such placements, in various combinations, are envisioned within the scope of the present invention.

ALTERNATIVE EMBODIMENTS

Although it is discussed herein that the Ku-band LNBF 114 can be moved away from the focal point 306 of the antenna 108, the Ku-band LNBF 114 can also be moved away from the focal plane of the antenna 108 where the focal plane includes the focal point 306. So, for example and not by way of limitation, rather than moving the Ku-band LNBF 114 in a planar fashion away from the focal point 306, the Ku-band LNBF 114 can be moved out of the focal plane and be placed behind the Ka-band LNBF 114 or in front of the Ka-band LNBF 114. Typically, placing the Ku-band LNBF 114 in front of the Ka-band LNBF 114 would be undesirable, because the Ku-band LNBF 114 could block signal reception at the Ka-band LNBF 114.

There is some impact in performance for the LNBF 114 that is moved away from its' ideal focal point and/or focal plane. Such impact is typically overcome, however, by increasing the size of the reflector dish, to increase the amount of power focused not only at the focal point for that orbital location, but also at other locations near to the focal point, where the LNBF boresight would reside. As such, the LNBF 114 that has a larger reflector can be moved away from the focal point with minimal system impact, so long as the reflector dish and the position of the boresight of the moved LNBF 114 provide similar signal strengths to the new LNBF 114 off-focus location.

Further, although described with respect to Ka-band and Ku-band signals, any two frequency bands can be utilized without departing from the scope of the present invention.

Flowchart

Figure 7:
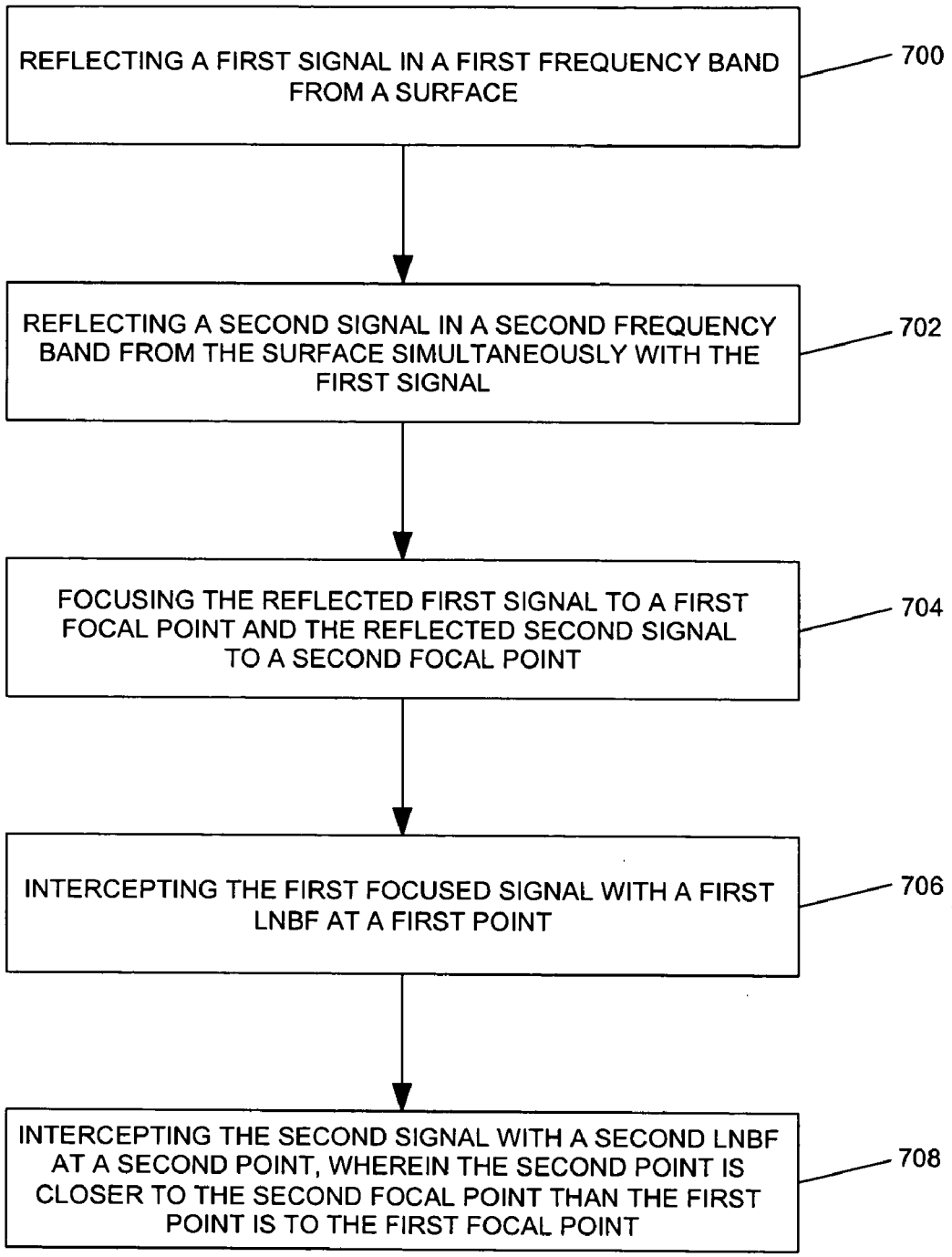
FIG. 7 is a flowchart illustrating the steps used in performing the present invention.

FIG. 7 is a flowchart illustrating the steps used in performing the present invention.

Box 700 represents reflecting a first signal in a first frequency band from a surface.

Box 702 represents reflecting a second signal in a second frequency band signal from the surface simultaneously with the first signal.

Box 704 represents focusing the reflected first signal to a first focal point and the reflected second signal to a second focal point.

Box 708 represents intercepting the first focused signal with a first LNBF at a first point.

Box 710 represents intercepting the second signal with a second LNBF at a second point, wherein the second point is closer to the second focal point than the first point is to the first focal point.

CONCLUSION

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

The present invention discloses a method and apparatus for receiving signals transmitted from a plurality of communications satellites. An apparatus in accordance with the present invention comprises a reflecting surface having a focal point, and a plurality of low noise block down converters with feedhorns (LNBFs), each LNBF having a boresight, wherein at least a first LNBF receives signals in a first frequency band transmitted from a first communication satellite location that are focused at a first focal point and at least a second LNBF receives signals in a second frequency band transmitted from a second satellite location that are focused at a second focal point, wherein the boresight of the first LNBF is closer to the first focal point than the boresight of the second LNBF is to the second focal point.

It is intended that the scope of the invention be limited not by this detailed description, but rather by the claims appended hereto and the equivalents thereof. The above specification, examples and data provide a complete description of the manufacture and use of the composition of the invention. Since many embodiments of the invention can be made without departing from the spirit and scope of the invention, the invention resides in the claims hereinafter appended and the equivalents thereof.

What is claimed is:

1. An antenna unit for receiving signals transmitted from a plurality of communications satellites, comprising:

a reflecting surface having at least one focal point, each focal point associated with a communication satellite location; and a plurality of low noise block down converters with feedhoms (LNBFs), each LNBF having a boresight, wherein at least a first LNBF receives signals in a first frequency band transmitted from a first communication satellite location that are focused at a first focal point, at least a second LNBF receives signals in a second frequency band transmitted from a second satellite location that are focused at a second focal point, and a third LNBF that receives signals in the first frequency band transmitted from a third communication satellite location that are focused at a third focal point, wherein the boresights of the first and third LNBFs are closer to the first and third focal points than the boresight of the second LNBF is to the second focal point.

2. The antenna unit of claim 1, wherein the boresights of the first and third LNBFs are placed substantially at their respective focal points.

3. The antenna unit of claim 2, wherein the second LNBF is placed away from the plane that approximately comprises the focal point.

4. The antenna unit of claim 3, wherein the first frequency band is Ka-band.

5. The antenna unit of claim 4, wherein the second frequency band is Ku-band.

6. The antenna unit of claim 1, wherein the reflecting surface is designed to provide sufficient signal strength to the first LNBF and the placement of the second LNBF is subordinate to that of the first LNBF.

7. The antenna unit of claim 1, wherein the second LNBF is placed at a distance other than the focal length from the reflecting surface.

8. The antenna unit of claim 7, wherein the distance is greater than the focal length.

9. A method for receiving a signal, comprising:

reflecting a first signal in a first frequency band from a surface;

reflecting a second signal in a second frequency band from the surface simultaneously with the first signal;

reflecting a third signal in the second frequency band simultaneously with the first and second signals;

focusing the reflected first signal to a first focal point; the reflected second signal to a second focal point; and the reflected third signal to a third focal point;

intercepting the first focused signal with a first LNBF at a first point;

intercepting the second signal with a second LNBF at a second point, and intercepting the third signal with a third LNBF at a third point, wherein the third point and the second point are closer to the third focal point and second focal point respectively than the first point is to the first focal point.

10. The method of claim 9, wherein the third point and the second point are located substantially at the third focal point and the second focal point, respectively.

11. The method of claim 10, wherein the first frequency band is Ku-band.

12. The method of claim 11, wherein the second frequency band is Ka-band.

13. A satellite television signal reception system, comprising:

a reflecting dish having a focal point, the reflecting dish focusing signals broadcast from a plurality of satellites at at least a first orbital slot in at least a first frequency band and a second frequency band;

a first low noise block down converter with feedhorn (LNBF) having a first boresight for receiving a signal in the first frequency band;

a second LNBF having a second boresight for receiving a signal in the second frequency band, wherein the first boresight is placed closer to the focal point than the second boresight, and wherein the reflecting dish is designed to provide sufficient signal strength to the first LNBF and placement of the second boresight is subordinate to that of the first boresight; and a third LNBF with a third boresight for receiving signals broadcast from an orbital slot other than those received by the first LNBP and the second LNBP, wherein the other orbital slot has a second focal point, for receiving a signal in the first frequency band.

14. The satellite television signal reception system of claim 13, wherein placement of the second boresight is subordinate to that of the third boresight and the first boresight.

15. The satellite television signal reception system of claim 14, wherein the first and third boresights are placed substantially at the focal point and the second focal point respectively.

16. The satellite television signal reception system of claim 15, wherein the first frequency band is Ka-band and the second frequency band is Ku-band.

* * * * *